US006346671B1

(12) United States Patent
Ahrens et al.

(10) Patent No.: US 6,346,671 B1
(45) **Date of Patent: *Feb. 12, 2002**

(54) COAXIAL HIGH-FREQUENCY CABLE

(75) Inventors: Günter Ahrens, Langenhagen; Reimer Nagel; Horst Fischer, both of Hannover, all of (DE)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/132,184

(22) Filed: Aug. 11, 1998

(30) Foreign Application Priority Data

Aug. 29, 1997 (DE) ..... 197 37 759

(51) Int. Cl.[7] ..... H01B 11/00

(52) U.S. Cl. ..... 174/28; 174/102 R; 174/102 SP; 174/102 P

(58) Field of Search ..... 174/36, 102 R, 174/102 SP, 28, 29, 117 AS, 113 AS, 121 R, 124 G; 333/84 L, 237

(56) References Cited

U.S. PATENT DOCUMENTS

| | | | | | |
|---|---|---|---|---|---|
| 2,599,857 | A | * | 6/1952 | Mildner | 18/47.5 |
| 3,005,038 | A | * | 10/1961 | Donohue | 174/102 |
| 3,249,901 | A | * | 5/1966 | Spinner | 333/96 |
| 3,286,015 | A | * | 11/1966 | Hildebrand et al. | 174/29 |
| 3,490,496 | A | * | 1/1970 | Stearns | 138/112 |
| 4,181,486 | A | * | 1/1980 | Saito | 425/113 |
| 4,259,990 | A | * | 4/1981 | Rohner | 138/113 |
| 4,301,428 | A | * | 11/1981 | Mayer | 333/12 |
| 4,383,225 | A | * | 5/1983 | Mayer | 333/12 |
| 4,510,468 | A | * | 4/1985 | Mayer | 333/12 |
| 4,841,259 | A | * | 6/1989 | Mayer | 333/17.2 |
| 5,262,593 | A | * | 11/1993 | Madry et al. | 174/102 R |
| 5,742,002 | A | * | 4/1998 | Arredondo et al. | 174/29 |

FOREIGN PATENT DOCUMENTS

| | | | |
|---|---|---|---|
| DE | 19 43 229 | | 8/1968 |
| DE | 34 01 137 | | 7/1985 |
| DE | 0391412 | * | 4/1990 |
| DE | 40 37 972 | | 11/1990 |
| DE | 41 07 651 | | 9/1992 |
| DE | 196 22 736 | | 6/1995 |
| DE | 195 45 582 | | 6/1997 |
| DE | 196 02 754 | | 7/1997 |
| EP | 03 91 412 | | 4/1990 |
| EP | 05 03 129 | | 8/1992 |
| GB | 12 68 280 | | 3/1972 |

OTHER PUBLICATIONS

Database WPI, Section Ch, Week 198117, Derwent Publications Ltd., London, 6B; Class A85, AN 1981–29686D, XP002134130.

Patent Abstracts of Japan, vol. 013, No. 270 (E–776), Jun. 21, 1989.

* cited by examiner

*Primary Examiner*—Dean A. Reichard
*Assistant Examiner*—William H. Mayo, III
(74) *Attorney, Agent, or Firm*—Ware, Freesola, Van der Sluys & Adolphson LLP

(57) ABSTRACT

A coaxial high-frequency cable is described which having an inner conductor (1), a dielectric spacer (2) surrounding the inner conductor (1), and a tubular outer conductor (3) which is applied over the dielectric (2) and which is concentric with the inner conductor (1). To ensure operability in the event of a fire, the spacer is constructed from a combination of an insulating thermoplastic material and a mineral material.

12 Claims, 2 Drawing Sheets

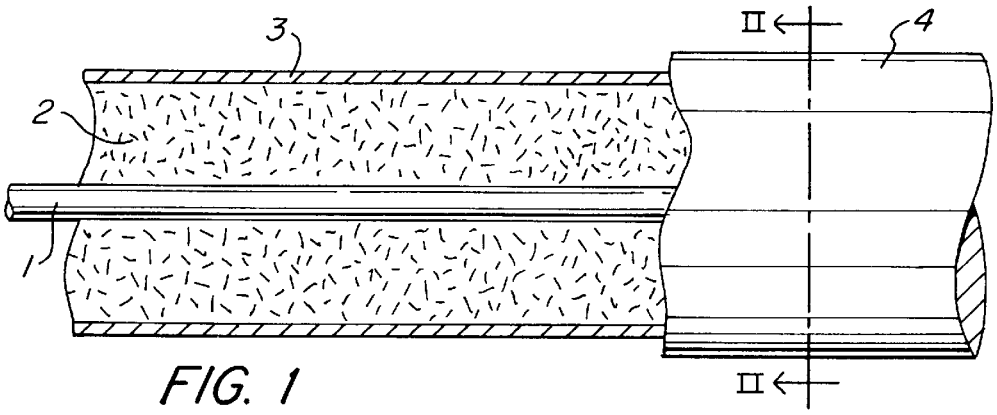
FIG. 1
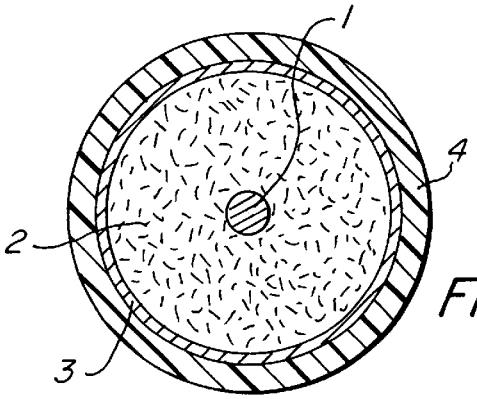
FIG. 2
FIG. 3
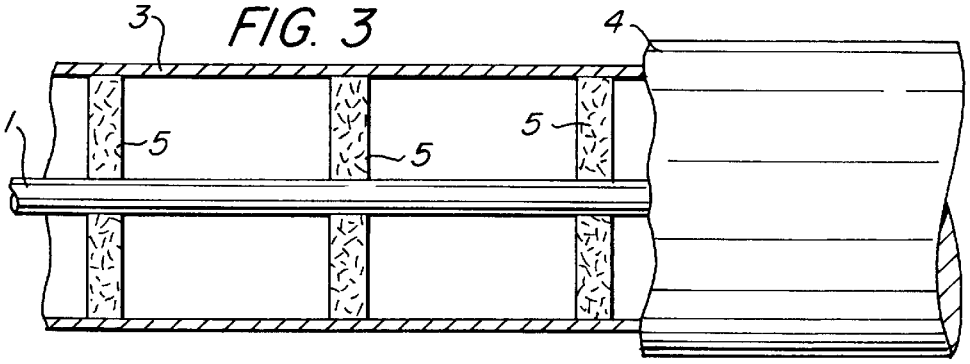
FIG. 4
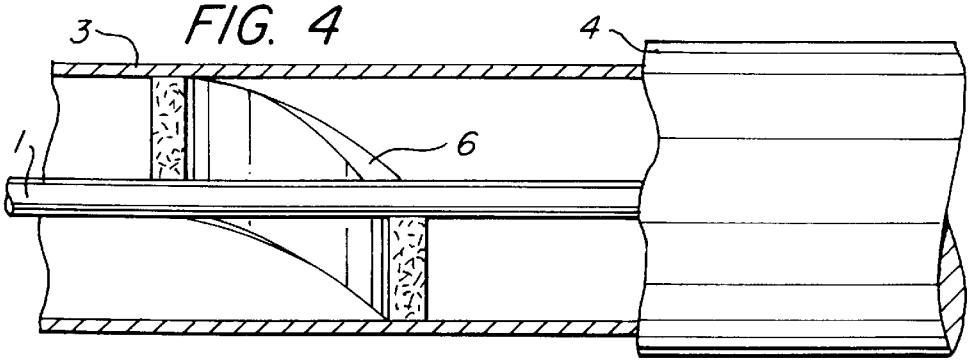

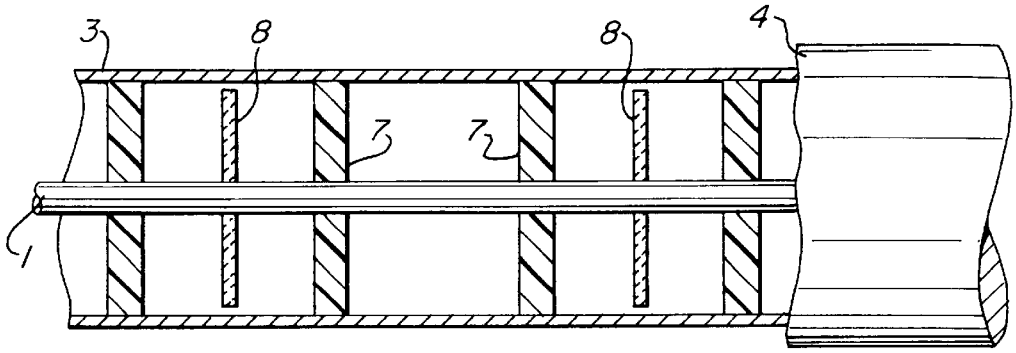
FIG. 5
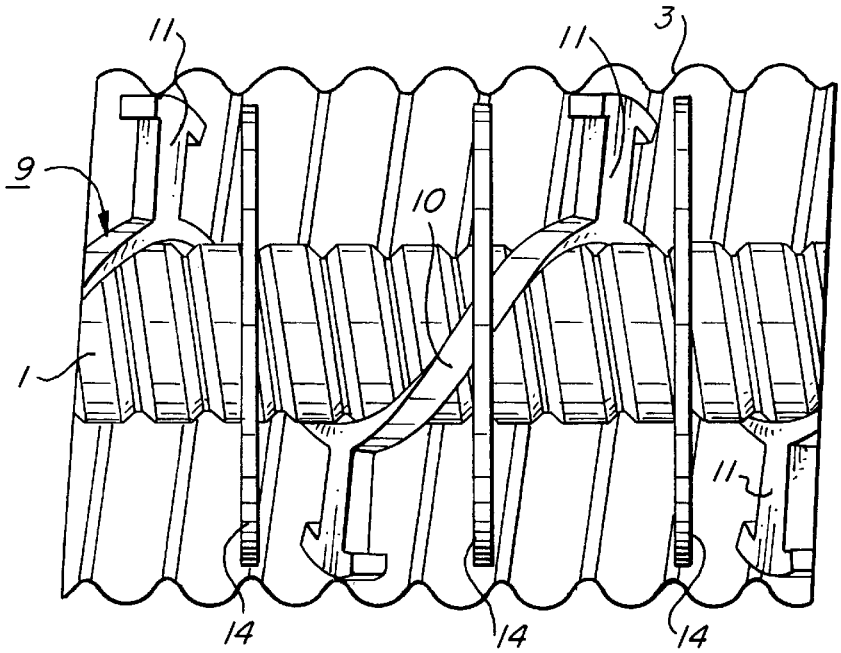
FIG. 6
FIG. 7
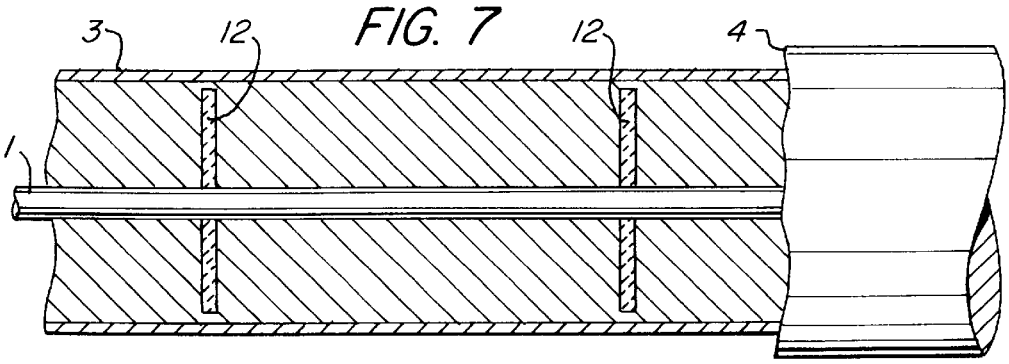

COAXIAL HIGH-FREQUENCY CABLE

BACKGROUND OF THE INVENTION

1. Technical Field

The invention relates to a coaxial high-frequency cable which has an inner conductor, a dielectric spacer surrounding the inner conductor, and a tubular outer conductor which is applied over the dielectric spacer and is concentric with the inner conductor.

2. Description of the Prior Art

Coaxial high—frequency cables—hereinafter referred to as "HF cables"—are used, for example, as interconnecting cables between a transmitter and an antenna for transporting electromagnetic waves. Such cables can also be installed, for example, in tunnel sections as a "radiating" HF cable. In conventional embodiments, the dielectric disposed between the inner conductor and the outer conductor functions as a spacer so as to hold the two conductors coaxially or concentrically and at a fixed separation relative to each other. The dielectric can be in the form of a tightly packed dielectric made from an insulating material which completely fills the space between the inner conductor and the outer conductor, either in solid form or in form of a foam. The dielectric can also be a so-called hollow dielectric with spacers made of an insulating material which contact both conductors. Such spacers can, for example, be in the form of a helix, in the form of axially spaced-apart disks and also in the form of individual elements. The HF cable is operational as long as the inner conductor and the outer conductor are undamaged and positioned concentrically relative to each other. The insulating material of the dielectric, however, can melt at very high temperatures, in particular in the event of a fire. The inner conductor and the outer conductor will come into contact within a very short time, thereby rendering the HF cable useless.

The spacer of the HF cable which is described in EP 0 503 129 A1 referenced above, is constructed in the form of a profiled helix or made from individually formed pieces of glass or ceramic. When these materials are employed, the corresponding HF cable can also be used at higher temperatures. The cable will also operate in the event of a fire, at least for a limited time. However, because the materials used for the spacers are quite brittle, the HF cable is rather expensive to manufacture. These materials also degrade the electrical properties of the cable.

SUMMARY OF THE INVENTION

It is the object of the invention to construct the HF cable of the type described above so that the cable can be manufactured with existing technology while simultaneously improving its electrical properties.

The object is solved with the invention in that the spacers are made from a combination of a thermoplastic insulating material and a mineral material.

The insulating material employed for this HF cable comprises two different components. When a thermoplastic insulating material is "filled", for example, with mineral particles, the HF cable can be manufactured with conventional processes, wherein the spacers in particular can have any shape and form. Conventional manufacturing techniques can also be employed when disks made of thermoplastic insulating material are used in conjunction with disks made of mineral material or other suitable individual support members. The thermoplastic insulating material is also an effective spacer when the HF cable is transported and installed. Moreover, the two-component material has significantly better dielectric properties than a purely mineral material, which helps to improve the transmission characteristics of the HF cable. When the mineral material is used, the inner conductor and the outer conductor do not contact each other at high temperatures or more particularly, in the event of fire, even after the thermoplastic material has melted. The HF cable therefore remains operational for a considerable period of time. When the two-component material is used for the spacers, the HF cable is easy to manufacture, has excellent electrical properties and operates even at high temperatures.

The invention will be fully understood when reference is made to the following detailed description taken in conjunction with the accompanying drawings.

BRIEF DESCRIPTION OF THE DRAWINGS

FIG. 1 is a cross-sectional view of an HF cable according to the invention,

FIG. 2 is a cross-sectional view taken along the line II-II of FIG. 1,

FIGS. 3 to 5 are cross-sectional views of different embodiments of the HF cable of the invention, FIG. 6 is a side view of a different embodiment of the HF cable of the invention with the outer conductor broken away to reveal internal structure, and FIG. 7 is a cross-sectional view of a different embodiment of the HF cable of the invention.

DETAILED DESCRIPTION OF THE INVENTION

The HF cable illustrated in the FIGS. 1 and 2 has a tightly packed dielectric which can be in form of a solid or a foam. The cable has an inner conductor 1, a dielectric 2 and a tubular outer conductor 3 applied concentrically over the inner conductor 1. A jacket 4 made, for example, of polyethylene can be placed over the outer conductor 3. The jacket 4 can also be made of a flame-retardant halogen-free material. The inner conductor 1 and the outer conductor 3 are preferably made of copper. The inner conductor 1 can be in the form of a smooth or a corrugated tube or can be in solid form. The outer conductor 3 can be a smooth tube, but can also be corrugated.

According to FIGS. 1 and 2, the dielectric 2 fills the entire space between the inner conductor 1 and the outer conductor 3 and acts as a spacer between the two conductors 1 and 3. The outer conductor 3 consequently makes contact with the dielectric 2 which is a two-component material composed of a thermoplastic insulating material and a mineral material. The mineral material is added to the thermoplastic insulating material in the form of a large number of particles. The particles are added to thermoplastic insulating material in a pre-manufacturing step and distributed as homogeneously as possible. The two-component material thus formed can be extruded onto the inner conductor 1 when the HF cable is manufactured.

The HF cable can also be constructed with a hollow dielectric as illustrated in the FIGS. 3 to 6. As illustrated in FIG. 3, the spacers for the two conductors 1 and 3 are here in the form of disks 5 which are spaced-apart axially and contact both conductors 1 and 3. The disks 5 can be extruded onto the inner conductor 1 in a similar fashion as described with reference to FIG. 1. The disks 5 can also be prefabricated and pushed onto the inner conductor 1.

The spacer of the HF cable of FIG. 4 is a helix 6. The helix 6 is prefabricated from the two-component material and is wound onto the inner conductor 1.

The mineral material can also be concentrically applied to an HF cable, leaving the design of the cable unchanged. For example, with an HF cable with a hollow dielectric according to FIG. 5, additional disks 8 made of a mineral material can be placed between two spacer disks 7 made of a thermoplastic material. The disks 8 can be spaced farther apart than the disks 7, because the disks 8 are used only to keep the HF cable operational when the disks 7 can no longer perform their function. This can happen, for example, in the event of a fire or if high temperatures occur for other reasons. Consequently, the disks 8 do not have to contact the outer conductor 3, at least not in a supporting function, when the HF cable is transported or installed and during normal operation. For this reason, the disks 8 can have a significantly smaller diameter than the disks 7. Preferably, the disks 8 contain very little material.

Disks made of a mineral material can also be employed with an HF cable where the spacer is a helix 9, as is illustrated, for example, in FIG. 6. The helix 9 has a continuous cordage 10 contacting the inner conductor 1 which is corrugated in the transverse direction. Spaced apart supports 11 protrude outwardly from the cordage 10, with the free ends of the supports 11 contacting the outer conductor 3 which is also corrugated in the transverse direction. The disks 14 made of mineral material as shown in FIG. 6, can be arranged in the regions between the supports 11. These disks 14 have cut-outs for receiving the cordage 10 of the helix 9. This embodiment likewise does not require that the mineral disks 14 provide support.

According to FIG. 7, the HF cable can also be provided with a tightly packed dielectric made of a thermoplastic material, either in solid form or in the form of foam. Disks 12 made of mineral material and separated from each other axially by a relatively large distance are arranged between the inner conductor 1 and the outer conductor 3. The disks 12 are constructed in the same manner as the disks 8 of FIG. 5.

The construction of the spacers from thermoplastic insulating material on the one hand and from mineral material on the other hand also applies when individual supports are installed.

The thermoplastic insulating material used in all embodiments can be made, for example, of polyethylene or polypropylene. The mineral material can be ceramic or glass. The outer conductor 3 is commonly applied over the dielectric after the dielectric is formed. The entire HF cable can be manufactured in a single operation. If desired, the jacket 4 can be applied in the same operation.

The HF cable of the construction described above is fully functional under normal operating conditions. The thermoplastic material melts at high temperatures, particularly in the event of a fire. However, the mineral particles contained in the thermoplastic material do not melt. They retain their function as spacers and prevent contact between the inner conductor 1 and the outer conductor 3. The HF cable therefore continues to function—albeit in a limited capacity.

The embodiments described above admirably achieve the objects of the invention. However, it will be appreciated that departures can be made by those skilled in the art without departing from the spirit and scope of the invention which is limited only by the following claims.

What is claimed is:

1. Coaxial high-frequency cable comprising:

(a) an inner conductor;

(b) a dielectric spacer surrounding the inner conductor and containing an insulating thermoplastic material and discrete bodies of mineral material; and (c) a tubular outer conductor applied over the dielectric spacer and concentric with the inner conductor, the tubular outer conductor being contacted and supported by the insulating thermoplastic material and not being supported and contacted by the discrete bodies of mineral material during normal operation, the tubular outer conductor being solely supported by the discrete bodies of mineral material at high temperature when the insulating thermoplastic material melts.

2. The cable according to claim 1, wherein the discrete bodies of the mineral material are disks, the dielectric spacer is constructed from disks of the insulating thermoplastic material and the disks of the mineral material which are axially spaced apart from each other.

3. The cable according to claim 2, wherein the disks of the insulating thermoplastic material and the disks of the mineral material are spaced apart from each other with different spacings therebetween.

4. The cable according to claim 1, wherein the dielectric spacer comprises a helix made of the insulating thermoplastic material with a continuous cordage contacting the inner conductor and having spaced apart outwardly projecting supports and the discrete bodies are disks made from the mineral material arranged between the supports.

5. The cable according to claim 1, wherein the discrete bodies are disks made of the mineral material which are arranged between the inner conductor and the outer conductor and are axially spaced apart from each other and the insulating thermoplastic material is tightly packed between the disks.

6. The cable according to claim 1, wherein the mineral material is ceramic.

7. The cable according to claim 1, wherein the mineral material is glass.

8. Coaxial high-frequency cable comprising:

(a) an inner conductor;

(b) a dielectric spacer surrounding the inner conductor and containing a combination of an insulating thermoplastic material and discrete particles of mineral material generally homogeneously dispersed in the thermoplastic material; and (c) a tubular outer conductor applied over the dielectric spacer in direct contact therewith and concentric with the inner conductor, the tubular outer conductor not being supported by the mineral material alone during normal operation and being solely supported by the mineral material at high temperature when the insulating thermoplastic material melts.

9. The cable according to claim 8, wherein the mineral material is ceramic.

10. The cable according to claim 8, wherein the mineral material is glass.

11. The cable according to claim 8, wherein the dielectric spacer is constructed of disks which are axially spaced apart from each other.

12. The cable according to claim 8, wherein the dielectric spacer is constructed of a helix wound onto the inner conductor.

* * * * *

UNITED STATES PATENT AND TRADEMARK OFFICE

CERTIFICATE OF CORRECTION

PATENT NO. : 6,346,671 B1
DATED : February 12, 2002
INVENTOR(S) : Gunter Ahrens et al.

It is certified that error appears in the above-identified patent and that said Letters Patent is hereby corrected as shown below:

Title page,
In the list of FOREIGN PATENT DOCUMENTS, the following should appear:

-- JP 56 022009 A 03/1981
JP 01 060909 A 03/1989 --.

Signed and Sealed this

Twenty-eighth Day of May, 2002

*Attest:*

*Attesting Officer*

JAMES E. ROGAN
*Director of the United States Patent and Trademark Office*